US005900273A

United States Patent [19]

Rasmussen et al.

[11] Patent Number: 5,900,273

[45] Date of Patent: May 4, 1999

[54] METHOD FOR COATING A SUBSTRATE COVERED WITH A PLURALITY OF SPACER MEMBERS

[75] Inventors: Robert T. Rasmussen, Boise; Charles M. Watkins, Meridian, both of Id.

[73] Assignee: Micron Technology, Inc., Boise, Id.

[21] Appl. No.: 08/588,871

[22] Filed: Jan. 19, 1996

[51] Int. Cl.[6] ..... B05D 1/26

[52] U.S. Cl. ..... 427/58; 427/430.1; 427/434.3

[58] Field of Search ..... 427/434.3, 430.1, 427/420, 96, 58; 118/419, 410

[56] References Cited

U.S. PATENT DOCUMENTS

| | | | |
|---|---|---|---|
| 4,370,356 | 1/1983 | Bok et al. | 427/38 |
| 4,696,885 | 9/1987 | Vijan | 430/311 |
| 4,938,994 | 7/1990 | Choinski | 427/96 |
| 5,270,079 | 12/1993 | Bok | 427/434.3 |
| 5,368,645 | 11/1994 | Bok | 118/500 |
| 5,516,545 | 5/1996 | Sandock | 427/420 |

OTHER PUBLICATIONS

C. Curtin, "The Field Emission Display: A New Flat Panel Technology", Record of 10991 Intl. Display Research Conf., Oct. 1991, pp. 12–15.

*Primary Examiner*—Katherine A. Bareford
*Attorney, Agent, or Firm*—Hale and Dorr LLP

[57] ABSTRACT

The object to be coated is exposed to a controlled rate of dispensing of liquid coating material and the rate of movement of the object is controlled with respect to the dispensing so that it is possible to control the coating thickness and rate of deposit with negligible damage to objects projecting from the surface of the object to be coated. Thus, it is possible to control production speed required to achieve the desired coating thickness with a meniscus coating system.

20 Claims, 4 Drawing Sheets

METHOD FOR COATING A SUBSTRATE COVERED WITH A PLURALITY OF SPACER MEMBERS

GOVERNMENT RIGHTS

This invention was made with Government support under Contract No. DABT63-93-C-0025 awarded by the Advanced Research Projects Agency (ARPA). The Government has certain rights in this invention.

BACKGROUND OF THE INVENTION

The present invention relates to a method and apparatus for improving the coating of flat or curved planar surfaces of substrates with liquid coatings, and in particular to coating surfaces having a plurality of fragile members adhered thereto and projecting therefrom without damaging these members.

Using flat field emission display devices as an illustrative example, it is important that uniform spacing be maintained between the cathode electron emitting surface (also referred to as the base electrode, baseplate, emitter surface, or cathode surface) and its corresponding anode display face (also referred to as an anode, cathodoluminescent screen, display screen, faceplate, or display electrode) in order to have proper operation and to prevent catastrophic electrical breakdown, there being a relatively high voltage differential (e.g., generally above 300 volts) between the cathode emitting surface and the display screen. At the same time, it is necessary to maintain the narrow spacing between the cathode and anode and to make these from relatively thin materials to achieve the desired structural thinness and high image resolution and brightness, as well as to avoid display distortion, etc. Uneven spacing between the electron emitting surface and anode is much more likely to occur in a field emission cathode, matrix addressed, flat vacuum type display than in other types of displays because of the narrow spacing and the thin materials used to form the baseplate and the faceplate. Spacers play an important role in maintaining the required uniform spacing and structural integrity of the large area, light weight, flat panel, field emission displays.

Spacers are incorporated between the faceplate and the plate upon which the emitter tips are fabricated. The spacers can be formed on a substrate by any of a number of methods, such as screen printing and stencil printing; by reactive ion etching and plasma etching of deposited materials; and by adhering a plurality of preformed spacers at defined sites on the substrate. The spacers formed by these methods must not be either too short for the high voltages encountered, or too wide as to interfere with the display image.

The application of thin coatings of coating materials, i.e., less than about 10 microns thick coatings, has become an increasingly important step in the manufacture of various products including, but not limited to: the above-mentioned flat panel displays. This is particularly true when the substrate includes a surface to be coated which has an array of fragile members adhered to and extending therefrom. These fragile members could include such things as the above discussed spacers, which might be damaged, destroyed, or removed by a coating process, to the ultimate degradation of the final product.

In a pre-metered coating process the process liquid, such as photoresist, developer, etchant, chemical stripper, solder mask, or any other liquid chemical can be coated onto the surface of a substrate. The term pre-metered coating refers to a process in which a controlled volumetric flow rate of coating liquid is fed into a coating applicator that is spaced a distance from the surface of a substrate to be coated. As the substrate passes by the applicator, the coating liquid issuing from the applicator is deposited onto the surface as a thin uniform layer.

Retained coating processes, such as dip coating, spin coating, screen coating or roll coating, expose the substrate's surface to an excess supply of coating liquid. When that excess coating liquid is removed, the amount retained on the substrate surface is a function of the coating fluid's rheological properties, (viscosity, etc.) and the coating process parameters. Generally, a liquid's viscosity will change if its percentage of solids changes either by loss of the coating fluid's solvent through evaporation or by over dilution of the coating liquid when solvent is back added to compensate for evaporation losses.

Spin coating is often used for applying resist coatings, but would be highly unsuitable in the present case as the centrifugal forces developed would damage the fragile members. There also is the possibility of streaking of the coated film due to interruption of the liquid path. Roll coating would also be unacceptable as it would clearly crush the fragile members. Dip coating and simpler coating methods provide less destructive methods for applying the coating material. However, the coating thickness and reproduciblity of the coating can be difficult to control, particularly when the surface to be coated has thereon members which will affect both the retention of and the runoff of the coating liquid.

Meniscus coating of an object, such as the above-mentioned substrate, is a known coating technique. In this process, a coating material is passed through a permeable surface of an applicator so as to develop a downward laminar flow of coating material on the outer surface of the applicator. An object is advanced so that the surface to be coated tangentially intersects the laminar flow of coating material near the apex of the applicator. Menisci of flowing coating material are formed both at the leading and the trailing edges of the coating material in contact with the surface to be coated and assure the uniform disengagement and drainage of excess coating material from the coated surface to the downward laminar flow of coating material on the outside surface of the applicator.

Capillary coating comprises placing the lower ends of two parallel, closely spaced plates into a reservoir of coating fluid so that, by capillary action, the coating fluid rises between the plates and forms a meniscus at the top opening between the plates. The substrate is then brought into contact with and moved relative to the meniscus so that a layer of coating material forms on the substrate. This method provides a fairly uniformly thick layer because the flow of coating material onto the substrate is adequately controlled by the capillary action. However, this method is usually limited to coating fluids having a viscosity of less than thirty centipoises.

Slot coating comprises an extrusion method in which a viscous coating material, under positive pressure, is passed through a thin elongated orifice that extends across and is in close proximity to, but spaced apart from, the surface of the substrate to be coated. A thin flexible continuous film is extruded from the orifice and deposited on the surface to be coated as it is moved linearly past the orifice so as to uniformly deposit the thin film thereon. Coatings of less than 100 microns can be deposited by this process.

Patch coating comprises dispensing a pre-metered amount of coating material onto a substrate with a pre-configured layer of coating liquid in controlled volume of liquid per unit area of substrate. The liquid is dispensed from an applicator slot coupled to a containment chamber in which the volume of liquid is varied in order to sharply start and stop the patch by producing a pulse of liquid. The substrate is moved relative to the applicator slot, at least during the period between formation and termination of the bead of liquid in order to produce a patch of the desired dimensions and uniform thickness.

Patents relating to meniscus coating include U.S. Pat. Nos. 4,370,356; 5,270,079; and 5,368,645. U.S. Pat. No. 4,938,994 relates to patch coating while U.S. Pat. No. 4,696,885 relates to capillary or slot coating. The disclosures of all of these patents are incorporated herein by reference.

SUMMARY OF THE INVENTION

The present invention concerns a process for applying coatings to planar substrates, having a plurality of fragile members adhered thereto, in such fashion as to not damage any existing structure. The coating is preferably applied by either a pre-metered process, such as patch coating, or a retained coating process, such as meniscus coating or capillary coating. The fragile members on the surface to be coated are not subject to any forces which would cause their destruction or in any manner adversely affect their functionality. The object to be coated can be moved relative to the applicator at a speed of less than 5 cm/min, preferably around 2.5 cm/min.

BRIEF DESCRIPTION OF THE DRAWINGS

The present invention will now be described, by way of example, with reference to the accompanying drawings in which.

DETAILED DESCRIPTION OF AN EMBODIMENT

Figure 1:
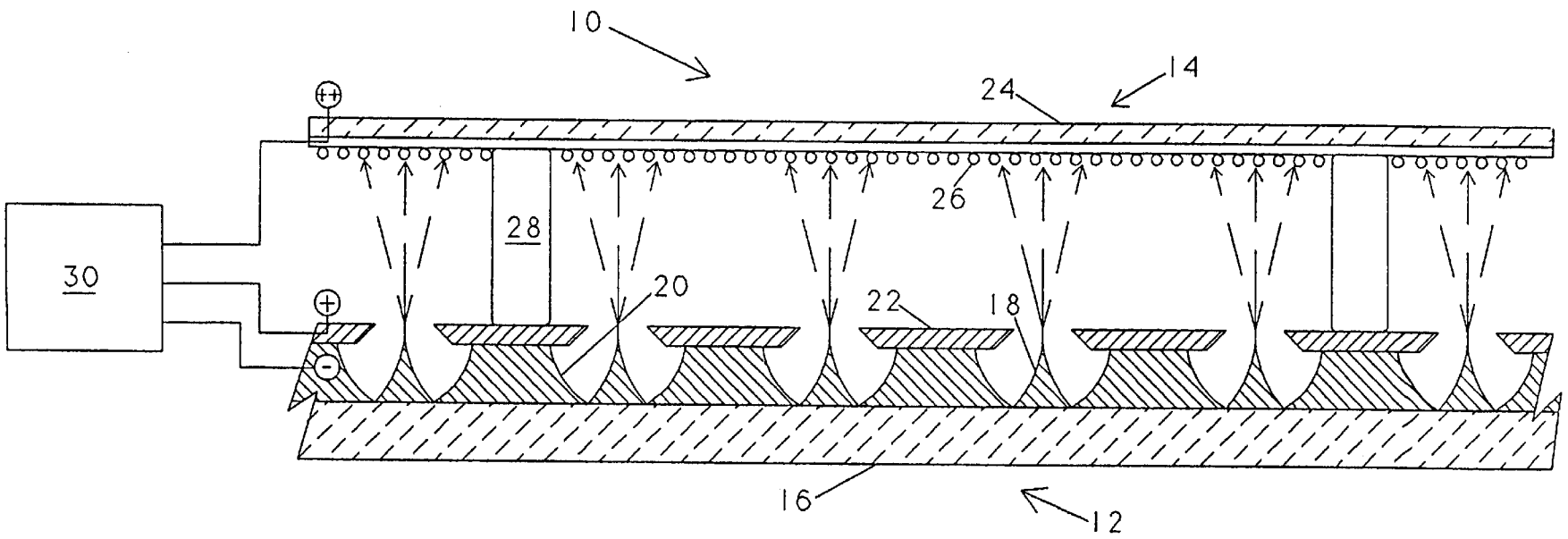
FIG. 1 is a schematic section through a representative field emission display.

FIG. 1 shows a representative section through a field emission display 10 having an electron emitting cathode 12 and an anode 14. The cathode is formed from a substrate 16 with a plurality of emitter sites 18 formed thereon in spaced patterned array. The emitter sites 18 are surrounded by a dielectric layer 20 and a grid 22 overlies the dielectric layer 20 and exposes the emitter sites 18. The anode screen 24 is provided with a phosphor coating 26 and the plates are spaced by a plurality of spacer members 28. The cathode, anode and grid are connected to source 30.

The particular object to be coated is not critical to the present invention. However, it is advantageous if the surface to be coated provides attractive forces for the coating material, i.e., the surface is wetable by the coating material. Preferably, the object should have curved or flat planar surfaces to be coated. The object to be coated can be made of substantially any material, for example, glass, ceramics, metals, plastics, and combinations thereof. Typical objects suitable for coating include, but are not limited to; flat panel displays, such as are used in laptop computers; high definition television and computer cathode ray tubes; optical devices, such as lenses, color filters and mirrors; hybrid circuit boards; and silicon and germanium wafers, generically referred to semiconductors.

Similarly, the particular coating material used to coat the objects is not critical to the present invention. Typical coating materials include, but are not limited to, photo resists, lacquers, dopants, polyimides, anti-reflective coatings and the like. The coating material will generally be present in liquid form dissolved in a solvent. The concentration of the coating material in the solution of solvent and coating material, often expressed as "solids content", will typically be from about 0.5 to 50 weight percent and preferably from about 0.5 to 15 weight percent, based on the total weight of the coating material and the solvent. These ranges will vary in accordance with the material. For example, in a resist coat a higher solids content aids in the creation of a uniform coating. However, a binder preferentially has a lower solids content because a high solids content would be detrimental to the performance of the completed device. Preferably, the liquid containing the coating material is capable of wetting, i.e., forming a film, the surface of the object to be coated. Typical solvents used with the coating materials include, for example, N-methylpyrrolidone, xylene, isopropanol, methyl ethyl ketone and water. Those skilled in the art can determine the appropriate coating materials, solids content and solvents in amounts suitable for the specific objects to be coated.

Figure 2:
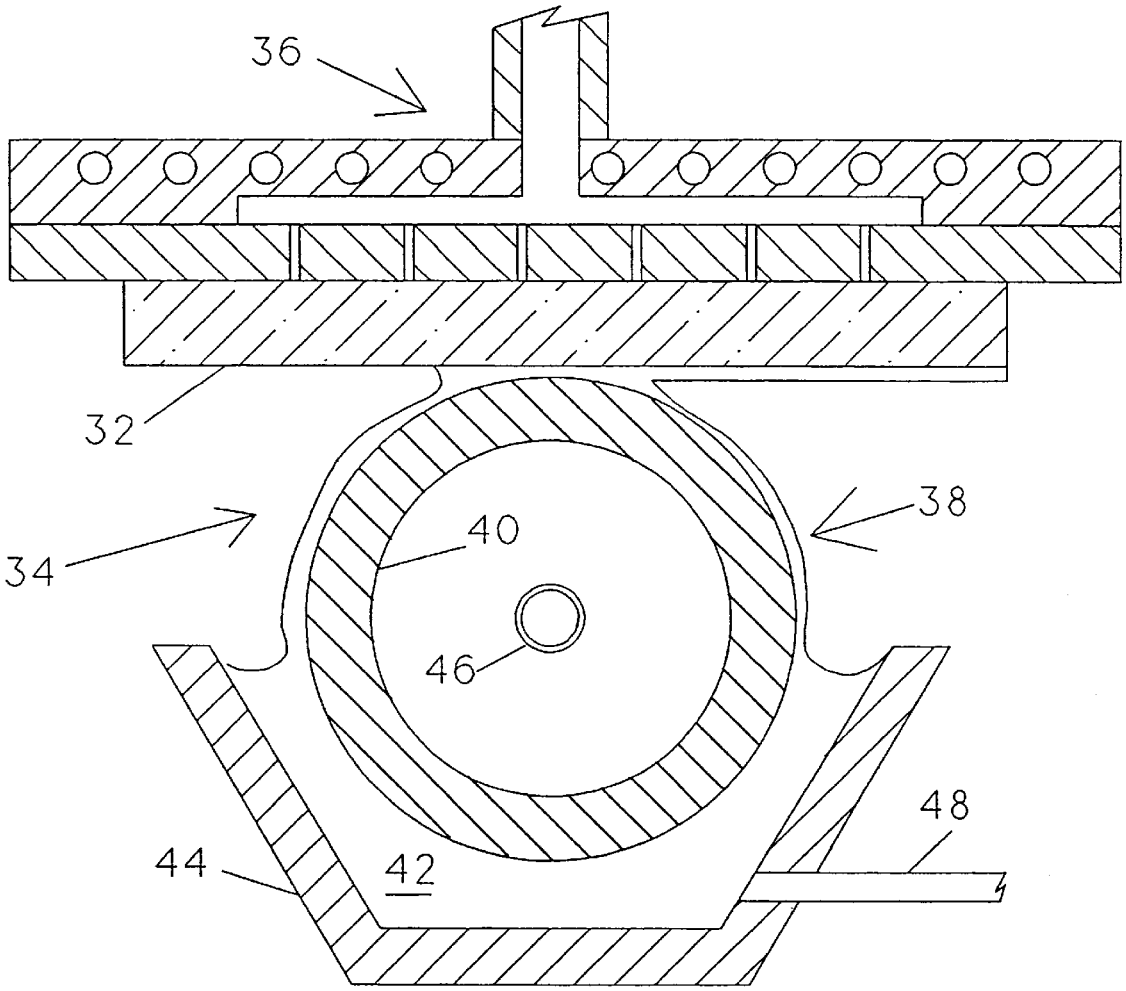
FIG. 2 is a diagrammatic section through a representative meniscus coating apparatus suitable for carrying out the present invention.

FIG. 2 illustrates a substrate 32 to be coated according to a meniscus coating method. The coating apparatus 34 comprises a vacuum chuck assembly 36 and an applicator assembly 38.

The construction of the vacuum chuck assembly 36 is not critical. Thus it can comprise any suitable materials known to those skilled in the art, such as, for example, steel, aluminum, alloys, plastics, carbon fiber, composite materials and the like. The vacuum chuck assembly 36 would be provided with the necessary known equipment (not shown) commonly used in conjunction with a vacuum chuck assembly. For example, vacuum pumps, tubing, valves, couplings, and the like are employed to provide appropriate vacuum for holding the object 32 to be coated against the chuck and to move the object relative to the applicator assembly 38. The details concerning such equipment and their operation are known to those skilled in the art and need not be discussed.

The applicator assembly 38 includes a porous, cylindrical applicator 40. The porous cylindrical applicator can be formed of, for example but not limited to, metal, plastic, or ceramic (often in a sintered state), and preferably has a uniform, interconnected, open cell structure. The cylindrical applicator 40 can either be rotatably or fixedly supported upon its longitudinal axis, with at least a lower portion engaging a supply of coating material 42 in trough 44. The coating material 42 is fed axially into the applicator through a sintered metal tube 46 and excess coating material is drained from trough 44 via outlet 48. The applicator assembly 38 would be provided with the necessary known equipment (not shown) commonly used in conjunction with a such assembly. For example, pumps, tubing, valves, couplings, and the like are employed to control flow of coating fluid through the assembly. The details concerning such equipment and their operation are known to those skilled in the art and need not be discussed.

Meniscus coating is particularly suitable in the present instance because it is a fairly gentle process for applying a coating. In order to get uniform coatings on surfaces that have substantial topography, such as the above discussed spacers, it is necessary to run the coating slowly, such as less than 5 cm/min., and preferably around 2.5 cm/min. The slow coating speed yields a more conformal coating. In order to adjust the overall coating thickness, the percentage of solids (and thus the viscosity) are adjusted so that at the desired speed, the desired coating thickness is achieved.

Figure 3:
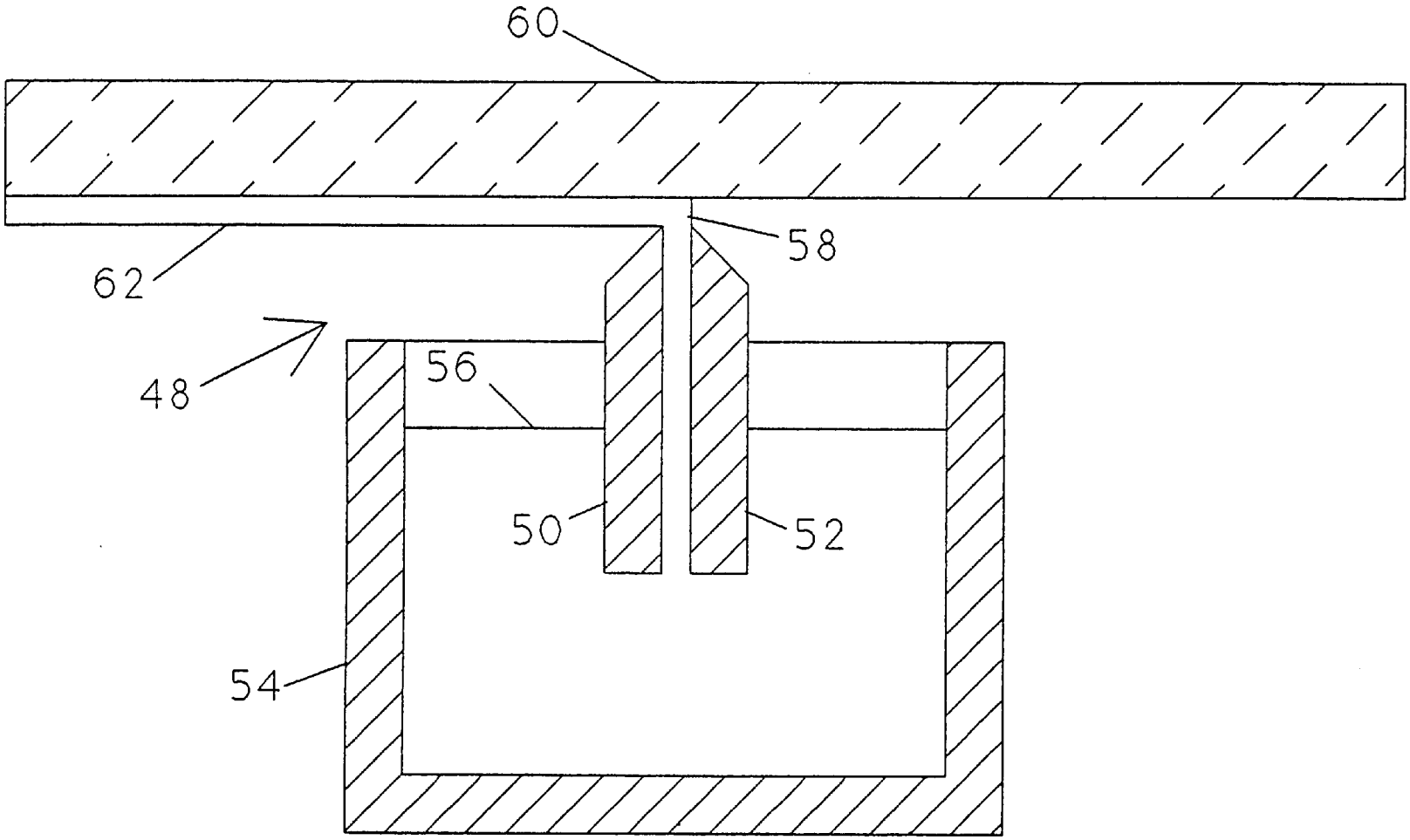
FIG. 3 is a schematic section through a representative capillary coating apparatus.

Capillary coating, as shown in FIG. 3, comprises placing the lower ends of two parallel, closely spaced plates 50 and 52 into a reservoir 54 of coating fluid 56 so that, by capillary action, the coating fluid rises between the plates and forms a meniscus 58 at the top opening between the plates. The substrate 60 could be held in a vacuum chuck (not shown) similar to the one described above. The substrate 60 is then brought into contact with and moved relative to the meniscus so that a layer of coating material forms on the substrate. This method provides a fairly uniformly thick layer because the flow of coating material onto the substrate is adequately controlled by the capillary action. However, this method is usually limited to coating fluids having a viscosity of less than thirty centipoises.

Figure 4:
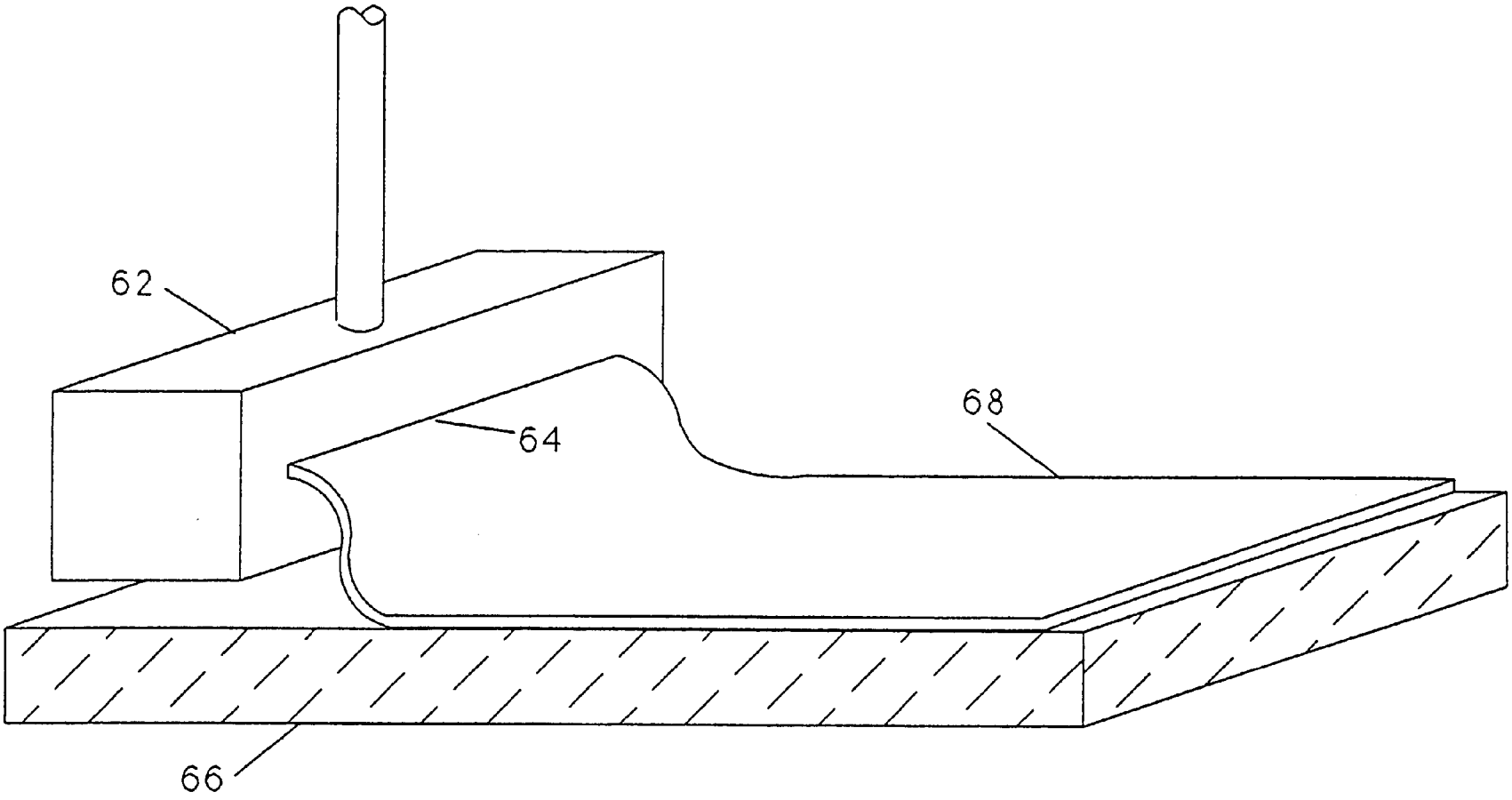
FIG. 4 is a schematic section through a representative patch or slot coating apparatus.

Referring to FIG. 4, the illustrated slot coating apparatus is somewhat similar to a capillary coater except that it is operated under pressure. The slot coater uses an extrusion method in which a viscous coating material, under positive pressure, is passed from extruder 62 through a thin elongated orifice 64 that extends across and is in close proximity to, but spaced apart from, the surface of the substrate 66 to be coated. A thin flexible continuous film 68 is extruded from the orifice and deposited on the surface to be coated as it is moved linearly past the orifice so as to uniformly deposit the thin film thereon. Coatings of less than 100 microns can be deposited by this process.

The present invention may be subject to many modifications and changes without departing from the spirit or essential characteristics thereof. The present embodiment should therefore be considered in all respects as being illustrative and not restrictive of the scope of the invention as defined by the appended claims.

We claim:

1. A method of providing a coating material on an object to coat the object, said method comprising:

moving an object to be coated relative to an applicator for providing said coating material such that a leading surface portion of the object to be coated intersects said coating material issuing from the applicator to provide the coating material on the object, wherein the object to be coated includes a substrate for a field emission display (FED) and has a plurality of spacer members extending away from the surface, the members having appropriate height and cross-sectional area to serve as spacers in an FED; and controlling a relative flow of said coating material and a rate of movement of said object relative to the applicator such that the spacer members on the surface of the object to be coated are not damaged such that they can serve as spacer members in the FED.

2. A method according to claim 1 wherein the coating material is dissolved in a solvent with the concentration of the coating material in the solvent being in a range of from about 0.5 to 50 weight percent, based on the total weight of the coating material and the solvent.

3. A method according to claim 1 wherein the concentration of the coating material in solvent is in the range of from about 0.5 to 15 weight percent.

4. A method according to claim 1 wherein the object to be coated is moved at a rate of less than 5 cm/min.

5. A method according to claim 1 wherein said coating material is applied by a meniscus coating method.

6. A method of coating a plate of a field emission display (FED) having a substrate and a plurality of separate spacer members connected to and extending away from and perpendicular to the substrate, including applying a coating to the substrate with spacer members with a liquid coating material to form a layer no greater than 10 microns in depth, the applying including controlling a relative flow of coating material and a rate of movement of said plate relative to an applicator with the coating material so that the spacers are not damaged such that they can serve as spacer members in the FED.

7. The method of claim 6, wherein the plate and the applicator with the coating material have a relative speed less than 5 cm/min.

8. The method of claim 7, wherein the relative speed is apprpximately 2.5 cm/min.

9. The method of claim 6, wherein the viscosity of the liquid has less than 30 centipoise.

10. The method of claim 6, wherein coating the plate includes coating a faceplate for a field emission display.

11. The method of claim 6, wherein coating the plate includes coating a cathode for a field emission display, the cathode having a number of electron emitting microtips.

12. The method of claim 6, wherein coating the plate includes coating with a pre-metered process.

13. The method of claim 6, wherein coating the plate includes coating with a retained coating process.

14. The method of claim 13, wherein the retained coating process is a meniscus coating process in which an applicator is moved relative to the plate.

15. The method of claim 14, wherein the relative speed of the applicator and the plate is no more than 5 cm/min.

16. The method of claim 14, wherein the relative speed of the applicator and the plate is no more than 2.5 cm/min.

17. The method of claim 6, wherein the retained coating process is a capillary coating process.

18. The method of claim 6, wherein the coating material is selected from the group consisting of lacquers, polyimides, and anti-reflective coatings.

19. A method of coating a plate of a field emission display (FED), the plate having a substrate and a plurality of separate spacer members attached to and extending away from and perpendicular to the substrate for spacing the plate from another plate in the FED, the coating method including moving an applicator relative to the plate to apply a coating material to the substrate with spacer members, the applying including controlling a relative flow of coating material and a rate of movement of said plate relative to the applicator so that the spacer members are not damaged by the coating process so that the spacer members can perform a spacing function in the FED.

20. The method of claim 19, wherein the coating method includes a meniscus coating method.

* * * * *